US012366060B2

(12) United States Patent
Rathammer

(10) Patent No.: US 12,366,060 B2
(45) Date of Patent: Jul. 22, 2025

(54) DRAIN DEVICE

(71) Applicants: Andre Rathammer, Vienna (AT); Harald Fechter, Vienna (AT)

(72) Inventor: Andre Rathammer, Vienna (AT)

(73) Assignees: Andre Rathammer, Vienna (AT); Harald Fechter, Vienna (AT)

( * ) Notice: Subject to any disclaimer, the term of this patent is extended or adjusted under 35 U.S.C. 154(b) by 220 days.

(21) Appl. No.: 17/781,641

(22) PCT Filed: Dec. 2, 2020

(86) PCT No.: PCT/EP2020/084300
§ 371 (c)(1),
(2) Date: Jun. 1, 2022

(87) PCT Pub. No.: WO2021/110758
PCT Pub. Date: Jun. 10, 2021

(65) Prior Publication Data

US 2022/0412063 A1 Dec. 29, 2022

(30) Foreign Application Priority Data

Dec. 6, 2019 (AT) ..... A 51068/2019

(51) Int. Cl.
*E03C 1/284* (2006.01)

(52) U.S. Cl.
CPC ..... *E03C 1/284* (2013.01)

(58) Field of Classification Search
CPC .... E03C 1/28; E03C 1/284; E03C 1/286–288; E03C 1/1225
See application file for complete search history.

(56) References Cited

U.S. PATENT DOCUMENTS 1,634,530 A 7/1927 Anderson
2,850,034 A * 9/1958 Svabek, Jr. ..... E03C 1/108 251/333

(Continued)

FOREIGN PATENT DOCUMENTS

AT 523236 A1 6/2021
CN 205875290 U 1/2017

(Continued)

OTHER PUBLICATIONS

Japanese Office Action dated Aug. 1, 2023 of Application No. 2022-533359.

(Continued)

*Primary Examiner* — David P Angwin
*Assistant Examiner* — Nicholas A Ros
(74) *Attorney, Agent, or Firm* — Gordon & Jacobson, P.C.

(57) ABSTRACT

A drainage device is provided that includes an inlet opening connectable to a sanitary appliance, a drainage opening connectable to a sewage pipe, and a closure section arranged between the inlet opening and the drainage opening. Passage of gas between the inlet opening and the drainage opening can be prevented by filling the closure section with a liquid. The drainage device further includes an actuating means and a vent opening. In a rest position, the actuating means closes the vent opening. In an activation position, the actuating means releases the vent opening. In the activation position, a gas passage between the drainage opening and the vent opening is allowed. Other aspects are described and claimed.

10 Claims, 2 Drawing Sheets

(56) References Cited

U.S. PATENT DOCUMENTS

| | | | | | |
|---|---|---|---|---|---|
| 2,852,034 | A * | 9/1958 | Shames | F16L 55/07 | 137/216.2 |
| 3,107,682 | A * | 10/1963 | Young | E03C 1/295 | 137/895 |
| 4,185,654 | A * | 1/1980 | Young | E03C 1/122 | 137/216.2 |
| 4,597,404 | A * | 7/1986 | Van Marcke | E03C 1/28 | 137/15.08 |
| 6,845,527 | B1 * | 1/2005 | Kohn | E03C 1/284 | 4/679 |
| 7,908,685 | B2 * | 3/2011 | Ericson | E03C 1/1225 | 4/DIG. 16 |
| 10,125,479 | B2 * | 11/2018 | Gogoulis | E03C 1/284 | |
| 2009/0173396 | A1 * | 7/2009 | Spadavecchia | E03C 1/122 | 137/357 |
| 2015/0176261 | A1 * | 6/2015 | McAlpine | F16K 15/063 | 137/12 |

FOREIGN PATENT DOCUMENTS

| | | | | | |
|---|---|---|---|---|---|
| DE | 346287 | C | | 12/1921 | |
| JP | H0573069 | U | | 10/1993 | |
| JP | 2001026959 | | * | 1/2001 | E03C 1/12 |
| JP | 2001065018 | | * | 3/2001 | E03C 1/12 |
| JP | 2001065018 | A | | 3/2001 | |
| JP | 2016217096 | A | | 12/2016 | |
| KR | 101450461 | B1 | | 10/2014 | |
| WO | WO2015044650 | | * | 4/2015 | E03C 1/1225 |

OTHER PUBLICATIONS

PCT Search Report and Written Opinion dated Feb. 11, 2021 of application No. PCT/EP2020/084300.

* cited by examiner

DRAIN DEVICE

CROSS-REFERENCE TO RELATED APPLICATION(S)

This application is the National Stage of International Patent Application No. PCT/EP2020/084300 filed on Dec. 2, 2020, which claims priority from Austrian Patent Application No. A51068/2019 filed on Dec. 6, 2019, both of which are herein incorporated by reference in their entireties.

BACKGROUND

The invention relates to a drainage device, in particular a trap and an arrangement of a drainage device with a mounting device of a sanitary appliance.

In the prior art, traps are known for use with various sanitary appliances, for example, washbasins, showers, bathtubs, toilets or urinals. Such traps—drainage devices in general—are to ensure, among other things, that gas is prevented from passing from a sewage pipe to the ambient air. In particular, this serves the purpose of preventing the release of unpleasant odors into the environment of the sanitary appliance, i.e. in particular the ambient air.

Different embodiments of traps are known. A form often used is the so-called P-trap, where a water reception area is provided to prevent the passage of gas between the sewage pipe and the ambient air.

Many traps, including P-traps, have disadvantages in designs where the liquid draining from the sanitary application has a low head. In particular, continuous and immediate drainage of the liquid is problematic in such designs, since a certain static pressure must be overcome to allow the liquid to drain. However, this means that liquid accumulates up to a certain level and only then drains off intermittently, which is undesirable, especially in the case of washbasins, showers, etc. Even particularly space-saving trap designs are often inadequate with respect to the drainage of the liquid.

SUMMARY

It is therefore an object of the invention to provide a drainage device, in particular a trap, which overcomes the disadvantages of the prior art and which allows continuous and immediate drainage of the liquid and still ensures the trap even when the head of the draining liquid is low and/or the design of the drainage device is small.

This and other objects of the present invention are solved by a drainage device as described herein.

The invention thus relates to a drainage device, in particular a trap, which comprises an inlet opening, which is connectable to a sanitary appliance, and a drainage opening, which is connectable to a sewage pipe. Further, the device comprises a closure section, which is arranged between the inlet opening and the drainage opening. The passage of gas between the inlet opening and the drainage opening can be prevented by filling the closure section with a liquid.

According to the invention, it may be provided that an actuating means and a vent opening are provided, wherein, in a rest position, the actuating means closes the vent opening and, in an activation position, releases the vent opening, and wherein, in the activation position, a gas passage between the drainage opening and the vent opening is allowed.

The actuating means may thus assume at least two positions that are different from one another. The changeover between the rest position and the activation position can be effected in particular by liquid flowing through the drainage device.

Optionally, it is provided that the actuating means can be brought into the activation position by liquid flowing through the drainage device.

Optionally, it is provided that the actuating means is designed as an actuating lever which can be pivoted about a pivot axis. An actuating lever may in particular have two lever sections which are arranged on both sides of the pivot axis.

Optionally, the actuating means may comprise a closure element, which, in the rest position, rests against the vent opening and closes the same. In particular, the closure element may be part of a lever section of an actuating lever.

Optionally, it is provided that the actuating means comprises an angularly arranged inflow section. The inflow section may optionally be arranged at an end section of the actuating means or the actuating lever.

Optionally, it is provided that a connecting tube is arranged between the inlet opening and the drainage opening and comprises the closure section.

Optionally, it is provided that the connecting tube comprises a first drop section, a second drop section and a riser section, which is arranged between the first drop section and the second drop section.

Optionally, it is provided that the closure section is arranged in the area of the first drop section and the riser section, and that the actuating means is arranged in the area of the second drop section.

Curved connecting sections may optionally be arranged between the drop sections and the riser section. Preferably, the drop sections and the riser section extend substantially parallel to one another.

Optionally, it is provided that a fastening device is provided for fastening the drainage device to a further component. The fastening device can be designed as a latching device or as a clamping device.

Optionally, the fastening device comprises a recess, into which a holding area of a further component can be inserted.

Optionally, it is provided that the drainage device is a P-trap.

Optionally, it is provided that the vent opening is arranged in a housing of the drainage device and allows a gas passage between the environment of the drainage device and a connecting tube, which is arranged between the inlet opening and the drainage opening.

Optionally, it is provided that, in the area of the inlet opening, the connecting tube comprises an inlet section and, in the area of the drainage opening, a drainage section, the inlet section and the drainage section being arranged substantially orthogonally to one another.

Optionally, it is provided that the closure section is arranged between the inlet section and the drainage section.

Optionally, it is provided that the closure section is arranged in the area of a curved connecting section between the first drop section and the riser section.

The invention further relates to an arrangement of a drainage device according to the invention with a mounting device of a sanitary appliance, in particular with a flush-mounted box. The problem of the low head of the inflowing liquid described at the beginning occurs in particular with flush-mounted boxes, as these are usually of a particularly compact design.

Optionally, it is provided that the fastening device is connected to a holding area of the mounting device. For example, the holding area may be designed as an area which can be positively connected to the fastening device.

Optionally, it is provided that the arrangement additionally comprises a sanitary appliance, in particular a washbasin.

Optionally, it is provided that a drain of the sanitary appliance is connected to the inlet opening of the drainage device.

Further optional features of the invention become apparent from the dependent patent claims, the figures and the description of the exemplary embodiments.

In the following, the invention is discussed in detail on the basis of an exemplary embodiment. This exemplary embodiment serves merely to illustrate the function of a device having preferred features of the invention and is not intended to limit the scope of protection of the patent claims.

DETAILED DESCRIPTION OF THE PREFERRED EMBODIMENTS

Figure 2:
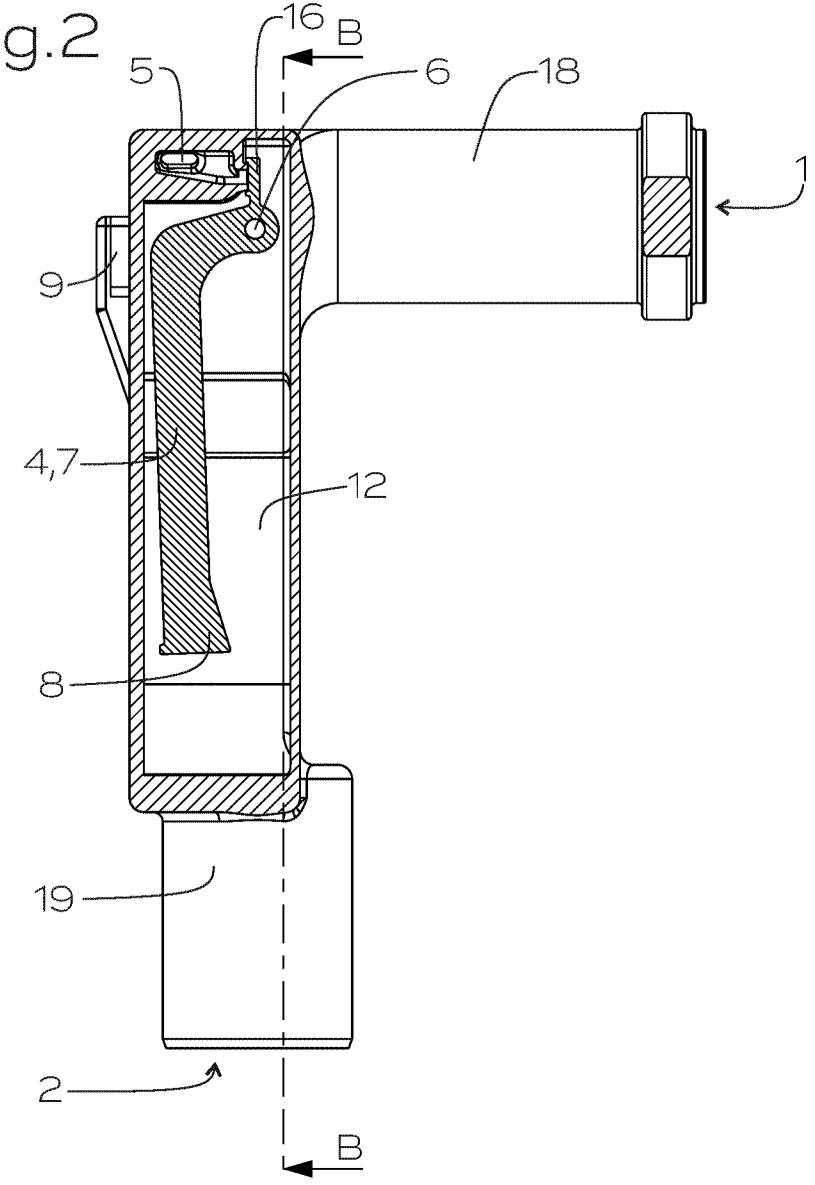
FIG. 2 shows a further lateral sectional view of a drainage device according to the exemplary embodiment of the present invention.
Figure 1:
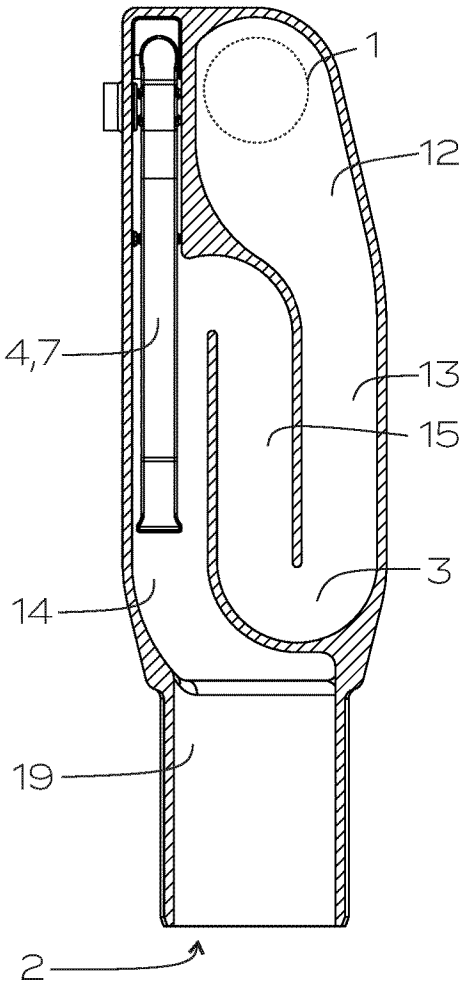
FIG. 1 shows a lateral sectional view of a drainage device according to an exemplary embodiment of the present invention.

FIGS. 1 and 2 show two lateral sectional views of a drainage device according to an exemplary embodiment of the present invention, the corresponding sectional planes each being arranged approximately orthogonally to one another.

The drainage device comprises an inlet opening 1 and a drainage opening 2. The inlet opening 1 is designed to be connected to a sanitary appliance, for example a washbasin. The drainage opening 2 is designed to be connected to a sewage pipe or, more generally, to a sewage system.

A connecting tube 12 is arranged between the inlet opening 1 and the drainage opening 2, which allows liquid to pass from the inlet opening 1 to the drainage opening 2. The drainage device shown in this exemplary embodiment is designed as a P-trap. Accordingly, the connecting tube 12 comprises a first drop section 13, a second drop section 14 and a riser section 15, which is arranged between the drop sections 13, 14. The individual sections extend substantially parallel to one another. The sections are arranged serially, i.e. consecutively, and are each connected to one another via curved connecting sections. In particular, the connecting tube 12 in this exemplary embodiment is of a substantially S-shaped design.

In this exemplary embodiment, the connecting tube 12 comprises an inlet section 18 and a drainage section 19, which are arranged substantially orthogonally to one another. The inlet section 18 is arranged in the area of the inlet opening 1, while the drainage section 19 is arranged in the area of the drainage opening 2. In this exemplary embodiment, the closure section 3, the drop sections 13, 14 and the riser section 15 are arranged between the inlet section 18 and the drainage section 19.

In the intended use of the trap shown in FIGS. 1 and 2, gas is to be prevented from passing from the drain pipe, which is connected to the drainage opening 2, into the ambient air of the sanitary appliance, which is connected to the inlet opening 1. In particular, this serves the purpose of preventing the release of unpleasant odors from the sewage system. Therefore, the drainage device comprises the closure section 3, which in this exemplary embodiment is arranged at the transition from the first drop section 13 to the riser section 15. The closure section 3 can be filled with a liquid, in particular with liquid draining from the sanitary appliance, and once the filling level of the closure section 3 is sufficient, the liquid prevents a gas passage from the drainage opening 2 to the inlet opening 1.

Due to the positioning of the inlet opening 1, the head and thus the flow pressure of the incoming liquid is low. In order to enable immediate and continuous drainage of the liquid from the sanitary appliance, the inventive drainage device of this exemplary embodiment comprises an actuating device 4 designed as an actuating lever 7. The actuating lever 7 is pivotally mounted about a pivot axis 6 and can assume at least a rest position and an activation position.

The actuating lever 7 assumes the rest position when no liquid flows through the drainage device. In the rest position, a closure element 16 of the actuating lever 7 closes a vent opening 5 in the housing 17 of the drainage device. The vent opening 5 provides a gas-permeable connection between the interior of the housing 17, i.e. the connecting tube 12, and the environment of the drainage device.

The actuating lever 7 assumes the activation position when liquid flows through the drainage device. Due to the pivoting movement of the actuating lever 7, the closure element 16 releases the vent opening 5 and gas is allowed to pass between the drainage opening 2 and the vent opening 5/the ambient air of the drainage device. This results in pressure equalization between the interior of the drainage device and the ambient air, and continuous drainage of liquid is ensured.

The vent opening 5 acts, among other things, as a pressure equalizer between the connecting tube 12 and the ambient air.

In order to improve the actuation of the actuating lever 7, it has an angularly arranged inflow section 8 in this exemplary embodiment. The inflow section 8 has a widened cross-section and is arranged at one end of the actuating lever.

As soon as liquid stops flowing through the drainage device, for example, after the supply of liquid to the sanitary appliance is stopped, the actuating lever moves back to the rest position in the absence of flow pressure from the liquid, so that a gas passage through the vent opening 5 and thus the formation of unpleasant odors in the ambient air is prevented. When the liquid flow is restored, the actuating lever 7 is returned to the activation position as described above.

The drainage device shown in FIGS. 1 and 2 also has a fastening device 9. The fastening device 9 is arranged on the housing 17 of the drainage device and serves to fasten the drainage device to a further component, for example to a mounting device. In particular, the fastening device 9 according to this exemplary embodiment serves to fasten the drainage device to a flush-mounted box.

Figure 3:
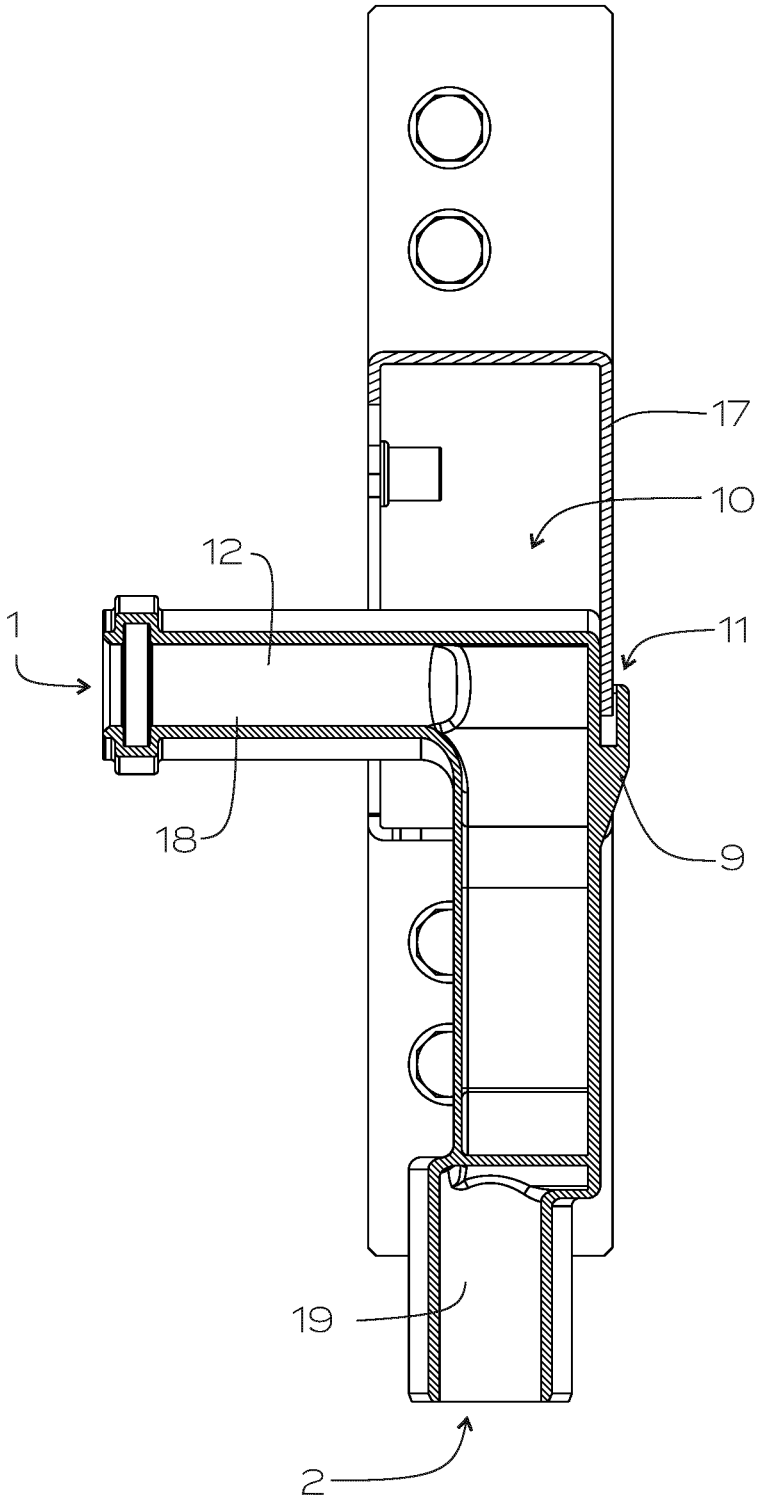
FIG. 3 shows a sectional view of an arrangement of the drainage device according to the exemplary embodiment on a flush-mounted box.

FIG. 3 shows a sectional view of an arrangement of the drainage device according to the exemplary embodiment on a flush-mounted box. The drainage device with the inlet opening 1, the drainage opening 2 and the connecting tube 12 arranged between the inlet opening 1 and the drainage opening 2 is attached to a wall of a flush-mounted box 10 via the fastening device 9. The wall has a holding area 11, which can be inserted into a recess of the fastening device 9. This facilitates the mounting of the drainage device according to the invention.

To simplify the illustration, some elements shown in FIGS. 1 and 2 are not shown in FIG. 3.

While the exemplary embodiment described herein shows a P-trap, the present invention is also applicable to other trap designs, for example, bottle traps, cup traps, or the like.

LIST OF REFERENCE SIGNS

1 Inlet opening
2 Drainage opening
3 Closure section
4 Actuating means
5 Vent opening
6 Pivot axis
7 Actuating lever
8 Inflow section
9 Fastening device
10 Flush-mounted box
11 Holding area
12 Connecting tube
13 First drop section
14 Second drop section
15 Riser section
16 Closure element
17 Housing
18 Inlet section
19 Drainage section

The invention claimed is:

1. A drainage device comprising:

an inlet opening, which is connectable to a sanitary appliance;

a drainage opening, which is connectable to a sewage pipe;

a connecting tube that connects the inlet opening and the drainage opening, wherein the connecting tube includes a closure section, which is arranged between the inlet opening and the drainage opening, wherein the closure section is configured such that passage of gas through the connecting tube between the inlet opening and the drainage opening is prevented by liquid filling the closure section; and an actuating lever configured to pivot about a singular fixed pivot axis to selectively open and close a vent opening, wherein the vent opening is operably coupled to the connecting tube between the closure section and the drainage opening, and wherein the actuating lever is disposed within the connecting tube and configured to contact liquid flowing through the connecting tube;

wherein the actuating lever is configured in a rest position when no liquid flows through the connecting tube, wherein the actuating lever is configured to move into the rest position solely by the absence of flow pressure from the liquid to close the vent opening;

wherein the actuating lever is configured in an activation position when liquid flows through the connecting tube, wherein in the activation position, the actuating lever opens the vent opening to provide passage of gas between the drainage opening and the vent opening;

wherein the actuating lever is configured to pivot about the singular fixed pivot axis into the activation position by contact of liquid flowing through the connecting tube with the actuating lever; and wherein the vent opening is arranged in a housing of the drainage device and allows for passage of gas from the drainage opening to the environment of the drainage device.

2. The drainage device according to claim 1, wherein the actuating lever has an angularly arranged inflow section.

3. The drainage device according to claim 1, further comprising a fastening device for fastening the drainage device to a further component.

4. The drainage device according to claim 1, wherein the actuating lever comprises a first lever section disposed above the pivot axis, and wherein the actuating lever comprises a second lever section disposed below the pivot axis.

5. The drainage device according to claim 1, wherein the connecting tube comprises a first drop section, a second drop section and a riser section, the riser section being arranged between the first drop section and the second drop section.

6. The drainage device according to claim 5, wherein the closure section is disposed in the area of the first drop section and the riser section, and wherein the actuating lever is disposed in the area of the second drop section.

7. The drainage device according to claim 5, wherein the closure section is disposed in the area of a curved connecting section between the first drop section and the riser section.

8. A drainage device according to claim 1, further comprising a mounting device of a flush-mounted box.

9. A drainage device according to claim 8, further comprising a fastening device connected to a holding area of the mounting device.

10. A drainage device according to claim 8, wherein the flush-mounted box is connected to the inlet opening of the drainage device.

* * * * *